US008529224B2

(12) United States Patent
Park et al.

(10) Patent No.: US 8,529,224 B2
(45) Date of Patent: Sep. 10, 2013

(54) HERMETIC COMPRESSOR HAVING AUXILIARY COMMUNICATION TUBE

(75) Inventors: Jeong Il Park, Hwaseong-si (KR); Jeong Hoon Kang, Seoul (KR); Ji Hoon Choi, Hwaseong-si (KR); Phil Soo Chang, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1036 days.

(21) Appl. No.: 12/078,869

(22) Filed: Apr. 7, 2008

(65) Prior Publication Data

US 2009/0028725 A1 Jan. 29, 2009

(30) Foreign Application Priority Data

Jul. 26, 2007 (KR) ..... 10-2007-074893

(51) Int. Cl.
*F04B 17/04* (2006.01)

(52) U.S. Cl.
USPC ..... 417/416; 417/417; 417/312; 417/902

(58) Field of Classification Search
USPC ..... 417/416, 417, 312, 902; 181/403
See application file for complete search history.

(56) References Cited

U.S. PATENT DOCUMENTS

| | | | | |
|---|---|---|---|---|
| 5,266,753 | A * | 11/1993 | Muschelknautz et al. | 181/224 |
| 6,481,756 | B1 * | 11/2002 | Field et al. | 285/124.1 |
| 6,524,080 | B1 * | 2/2003 | Chintamani et al. | 417/312 |
| 2004/0228741 | A1 * | 11/2004 | Kim et al. | 417/312 |

FOREIGN PATENT DOCUMENTS

| | | |
|---|---|---|
| JP | 11-351144 | 12/1999 |
| JP | 2006-29322 | 2/2006 |
| KR | 10-2007-0051063 | 5/2007 |

OTHER PUBLICATIONS

Korean Office Action issued Mar. 23, 2012 in corresponding Korean Patent Application No. 10-2007-0074893.

* cited by examiner

*Primary Examiner* — Charles Freay
*Assistant Examiner* — Christopher Bobish
(74) *Attorney, Agent, or Firm* — Staas & Halsey LLP

(57) ABSTRACT

A hermetic compressor for adjusting the length and cross sectional area of a communication path as a refrigerant flow passage, so as to attenuate a discharge pulsation and consequently, a vibration and noise thereof. The hermetic compressor, which includes a cylinder head having a discharge chamber to discharge a compressed refrigerant and a discharge muffler to receive the refrigerant discharged from the discharge chamber, further includes a communication path to communicate the discharge chamber and the discharge muffler with each other, so as to allow the refrigerant to flow from the discharge chamber into the discharge muffler, and an auxiliary communication tube to increase a length of the communication path for increasing a refrigerant flow distance. The auxiliary communication path reduces the cross sectional area of a refrigerant flow passage while increasing a refrigerant flow distance, thereby attenuating a low-frequency component of the discharge pulsation.

9 Claims, 4 Drawing Sheets

HERMETIC COMPRESSOR HAVING AUXILIARY COMMUNICATION TUBE

CROSS-REFERENCE TO RELATED APPLICATIONS

This application claims the benefit of Korean Patent Application No. 2007-0074893, filed on Jul. 26, 2007 in the Korean Intellectual Property Office, the disclosure of which is incorporated herein by reference.

BACKGROUND

1. Field

The present invention relates to a hermetic compressor, and, more particularly, to a hermetic compressor, which can attenuate a discharge pulsation caused upon discharge of a refrigerant, thereby reducing a vibration and noise.

2. Description of the Related Art

Generally, a refrigeration cycle employed in a refrigerator, etc. performs compression, condensation, expansion, and evaporation processes in sequence using a refrigerant as a medium. As one of the devices to perform the compression process, a reciprocating type compressor is configured such that a piston slidably reciprocates in a compression chamber to discharge a high-temperature/high-pressure refrigerant. The reciprocating type compressor includes a hermetic container defining the outer appearance of the compressor, a drive device received in the hermetic container to generate power, and a compression device to suction and compress a refrigerant upon receiving the power from the drive device so as to discharge a high-temperature/high-pressure refrigerant. The reciprocating type compressor is also referred to as a hermetic compressor.

More specifically, the compression device is located in a lower region of the hermetic container. The compression device includes a cylinder block to define the compression chamber, a piston to reciprocate in the compression chamber upon receiving the power from the drive device, and a cylinder head provided at a tip end of the cylinder block, the cylinder head having a refrigerant suction chamber and a refrigerant discharge chamber defined therein.

A valve assembly is provided between the cylinder block and the cylinder head. The valve assembly has a suction hole and a discharge hole to communicate the suction chamber and the discharge chamber with the compression chamber. The suction hole and the discharge hole are provided with a suction valve and a discharge valve, respectively, to adjust the flow of a refrigerant.

A suction muffler is disposed at the top of the cylinder head to attenuate a noise caused upon introduction of a refrigerant. The suction muffler is connected with a refrigerant inlet pipe. In addition, a discharge muffler is mounted at a lower surface of the cylinder block to attenuate a pressure pulsation caused upon discharge of a high-temperature/high-pressure refrigerant. The discharge muffler is connected with a refrigerant outlet pipe. In this case, to communicate the discharge muffler with the discharge chamber of the cylinder head, a communication path is defined in the cylinder block.

In the operation of the hermetic compressor having the above described configuration, if the piston moves to a bottom dead center of the compression chamber, a refrigerant is introduced into the compression chamber through the suction muffler and the suction chamber. Thereafter, as the piston moves to a top dead center of the compression chamber, the refrigerant is compressed and discharged into the discharge chamber of the cylinder head. Subsequently, the refrigerant is discharged into the discharge muffler through the communication path of the cylinder block.

However, since the above described reciprocating type compressor suctions, compresses, and discharges a refrigerant as the piston rectilinearly reciprocates in the compression chamber, it cannot continuously discharge the refrigerant and causes a discharge pulsation. The discharge pulsation of the refrigerant results in a vibration and noise of the compressor. In particular, a compressor noise generated in a low-frequency band of the discharge pulsation corresponding to a natural frequency of other elements of a refrigerator has a resonance with the elements, increasing a vibration and noise of the refrigerator.

To attenuate a noise generated from the discharge chamber of the cylinder head, it is necessary to consider certain factors, for example, the volume of the discharge muffler, and the length and cross-sectional area of a tube to communicate the discharge chamber with the discharge muffler, which has an effect on the natural frequency of the discharge muffler.

Although it has been proposed in the prior art to attenuate a discharge pulsation by increasing the volume of the discharge muffler, a limited inner space of the compressor makes it impossible to increase the volume of the discharge muffler beyond a predetermined level. Further, since the communication path is defined in the cylinder block, the length of the communication path is limited by the size of the cylinder block. Accordingly, it is difficult to prevent a discharge pulsation and low-frequency noise, and in particular, the low-frequency noise makes a person uncomfortable.

SUMMARY

Accordingly, it is an aspect of the invention to provide a hermetic compressor, which can adjust the length and cross-sectional area of a communication path for the flow of a refrigerant, thereby attenuating a discharge pulsation and consequently, a vibration and noise thereof.

Additional aspects and/or advantages of the invention will be set forth in part in the description which follows and, in part, will be apparent from the description, or may be learned by practice of the invention.

In accordance with an aspect of the invention, the above and/or other aspects can be achieved by the provision of a hermetic compressor comprising a cylinder head having a discharge chamber to discharge a compressed refrigerant and a discharge muffler to receive the refrigerant discharged from the discharge chamber, the hermetic compressor further including: a communication path to communicate the discharge chamber and the discharge muffler with each other, so as to guide the refrigerant from the discharge chamber into the discharge muffler; and an auxiliary communication tube to increase a length of the communication path for increasing a refrigerant flow distance.

The auxiliary communication tube may include a coupling portion to be coupled with the communication path and an extension portion extending from the coupling portion.

The communication path may have the same diameter as an inner diameter of the auxiliary communication tube, to assure smooth flow of the refrigerant.

An end portion of the communication path may be stepped to have the same diameter as an outer diameter of the coupling portion, to allow the auxiliary communication tube to be inserted into the communication path.

The auxiliary communication tube may be disposed in the discharge muffler.

The auxiliary communication tube may have a spiral shape.

The auxiliary communication tube may have a diameter smaller than a diameter of the communication path.

The auxiliary communication tube may include a coupling portion to be coupled with the communication path, and the coupling portion may be inserted into the communication path to reduce a cross sectional area of the communication path as a refrigerant flow passage.

The hermetic compressor may further have a cylinder block including a compression chamber to discharge the refrigerant into the discharge chamber, and the cylinder block may include a resonant channel having one end to communicate with the discharge chamber and the blocked other end.

The resonant channel may have a diameter larger than a diameter of the communication path.

In accordance with an aspect of the invention, the above and/or other aspects can be achieved by the provision of a hermetic compressor comprising a cylinder head including a discharge chamber to receive a refrigerant compressed in a compression chamber and a discharge muffler to receive the refrigerant discharged from the discharge chamber, the hermetic compressor further comprising: a first section as a refrigerant flow section from the compression chamber to the discharge chamber; a second section as a refrigerant flow section along a communication path to communicate the discharge chamber and the discharge muffler with each other; a third section as a refrigerant flow section from the discharge muffler to the outside of the compressor; and an auxiliary communication tube connected with the communication path to lengthen the second section.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
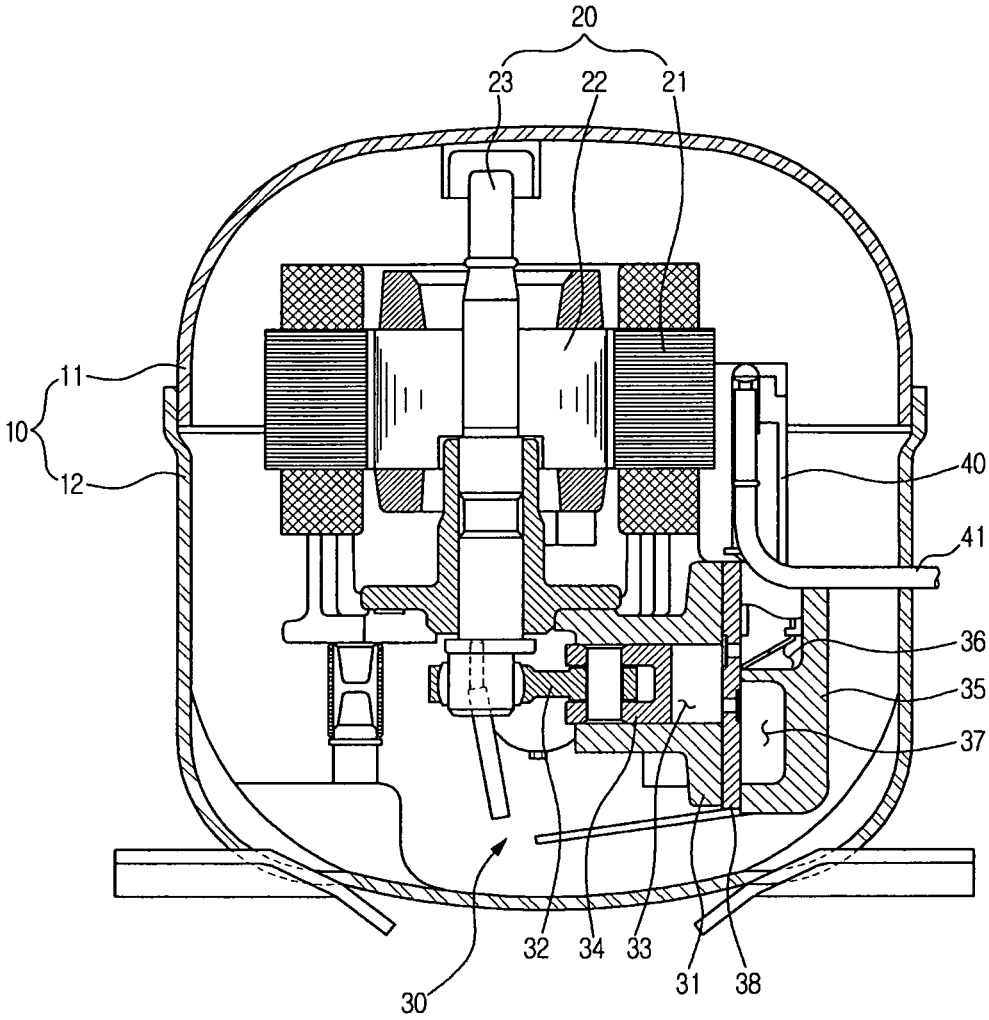
FIG. 1 is a sectional view showing a hermetic compressor in accordance with an exemplary embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

FIG. 1 is a sectional view showing a hermetic compressor in accordance with an exemplary embodiment of the present invention.

As shown in FIG. 1, the hermetic compressor has a housing 10 including an upper shell 11 and a lower shell 12, a compression device 30 disposed in a lower region of the housing 10 and including elements to compress a refrigerant, and a drive device 20 disposed in an upper region of the housing 10 to drive the compression device 30.

The drive device 20 includes a stator 21, a rotor 22 to be rotated by electromagnetic interaction with the stator 21, and a crankshaft 23 press-fitted in the center of the rotor 22.

The compression device 30 includes a cylinder block 31 disposed in the lower region of the housing 10, a connecting rod 32 eccentrically coupled to a lower end of the crankshaft 23, a piston 34 coupled to a tip end of the connecting rod 32 so as to rectilinearly reciprocate in a compression chamber 33 defined in the cylinder block 31, and a cylinder head 35 disposed at the right side of the cylinder block 31 to hermetically close the compression chamber 33.

The cylinder head 35 has a suction chamber 36 to receive a low-temperature/low-pressure refrigerant, and a discharge chamber 37 to receive a high-temperature/high-pressure refrigerant, which are divided from each other by a partition. A valve assembly 38 is installed between the cylinder head 35 and the cylinder block 31. The valve assembly 38 controls the flow of a refrigerant, to allow the refrigerant to be introduced from the suction chamber 36 into the compression chamber 33 or from the compression chamber 33 into the discharge chamber 37. Here, a refrigerant flow section from the compression chamber 33 to the discharge chamber 37 is referred to as a first section. In addition, a suction muffler 40 is installed at the top of the cylinder head 35, to communicate with the suction chamber 36. The suction muffler 40 is connected with a refrigerant suction pipe 41 to suction a refrigerant from an evaporator (not shown).

Figure 2:
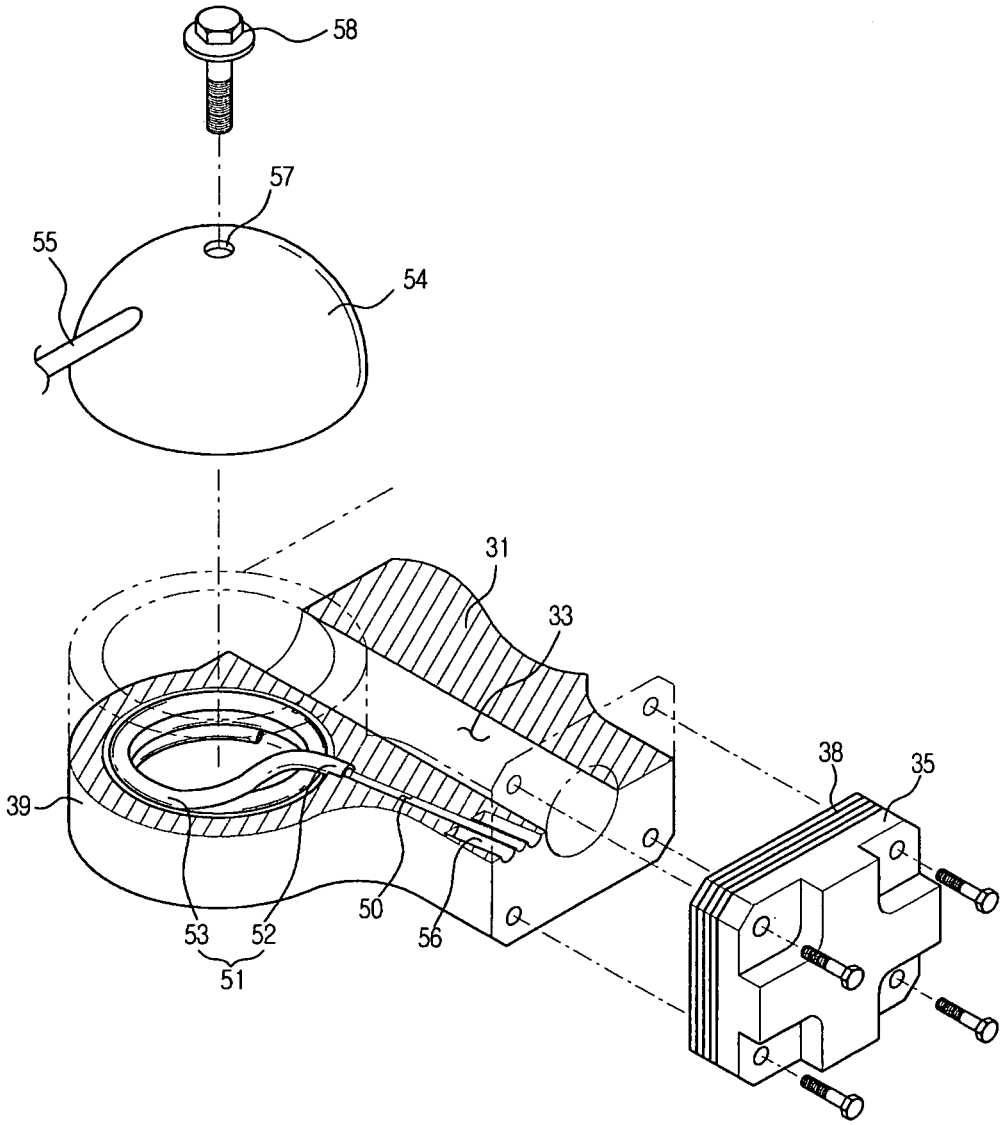
FIG. 2 is an exploded perspective view showing important parts of a compression device included in the hermetic compressor of FIG. 1.

FIG. 2 is an exploded perspective view showing important parts of the compression device included in the hermetic compressor of FIG. 1.

Figure 3:
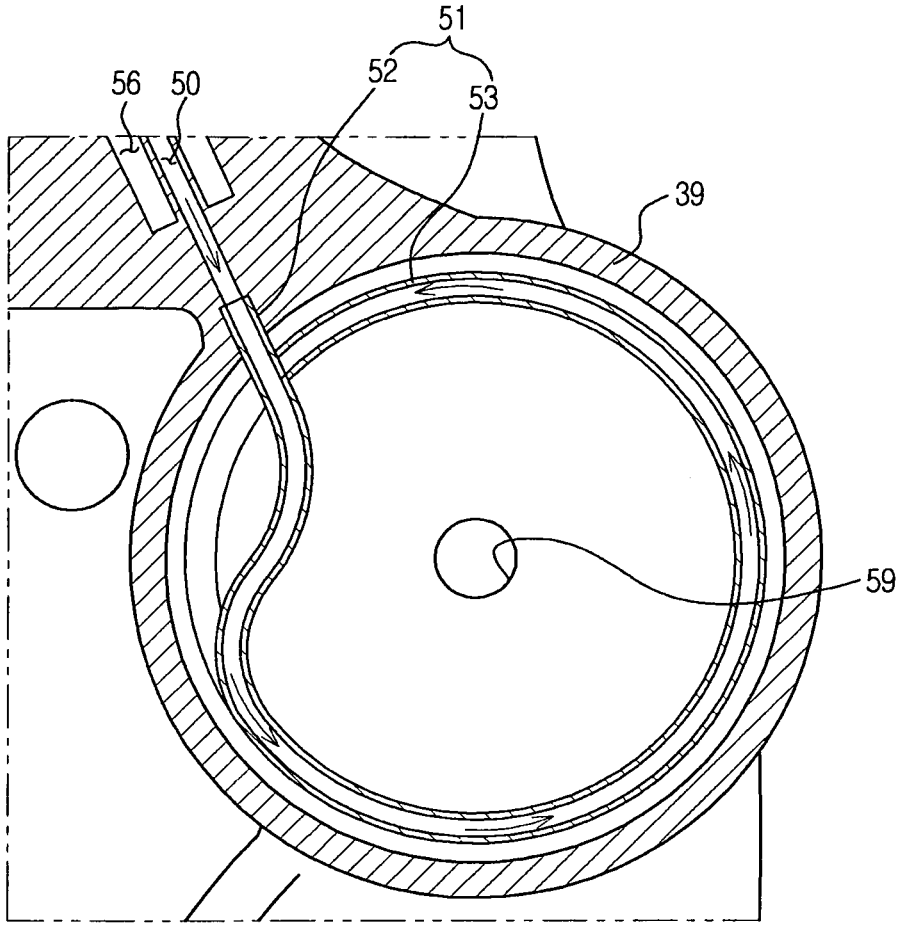
FIG. 3 is an enlarged sectional view showing a discharge muffler shown in FIG. 2.

FIG. 3 is an enlarged sectional view showing the discharge muffler shown in FIG. 2.

As shown in FIGS. 2 and 3, a discharge muffler 39 protrudes from a lower surface of the cylinder block 31. The discharge muffler 39 is hermetically closed by a muffler cover 54. Specifically, the muffler cover 54 is centrally perforated with a hole 57 for the insertion of a male screw 58, and the discharge muffler 39 has a female screw portion 59 formed therein so as to allow the male screw 58, having passed through the hole 57, to be fastened into the female screw portion 59. The muffler cover 54 is connected with a refrigerant outlet pipe 55 to supply a refrigerant into a condenser (not shown).

To allow the refrigerant received in the discharge chamber 37 of the cylinder head 35 to flow into the discharge muffler 39, the cylinder block 31 has a communication path 50 formed therein to communicate the discharge chamber 37 and the discharge muffler 39 with each other. Here, a refrigerant flow section along the communication path 50 is referred to as a second section. The communication path 50 may have various shapes. For example, the communication path 50 may have a stepped shape to have different diameter portions, or may have a curved shape. In the present invention, the communication path 50 has a tubular shape having a constant diameter. Exceptionally, it is noted that a distal end portion of the communication path 50 located toward the discharge muffler 39 is stepped to have the same diameter as an outer diameter of an auxiliary communication tube 51 that will be described hereinafter, to allow the auxiliary communication tube 51 to be inserted into and coupled with the communication path 50.

The auxiliary communication tube 51 has a predetermined diameter, and more specifically, has an inner diameter and an outer diameter. Preferably, the inner diameter is equal to the diameter of the communication path 50, and the outer diameter, as described above, is equal to the diameter of the stepped distal end portion of the communication path 50 located toward the discharge muffler 39 so as to be inserted into and coupled with the distal end portion of the communication path 50 (See FIG. 3).

The auxiliary communication tube 51 includes a coupling portion 52 to be coupled with the end portion of the communication path 50 located toward the discharge muffler 39, and an extension portion 53 extending from the coupling portion 52 to increase the flow distance of a refrigerant. The extension portion 53 has a spiral shape, and is disposed vertically in the discharge muffler 39. Since the coupling portion 52 has a straight shape and the extension portion 53 has a spiral shape, a connecting region of the coupling portion 52 and the extension portion 53 is curved. Preferably, the connecting region of the coupling portion 52 and the extension portion 53 has a gentle curvature to assure smooth flow of a refrigerant. By installing the auxiliary communication tube 51 in the discharge muffler 39, there is no need for a separate installation space of the auxiliary communication tube 51. Accordingly, the compressor of the present invention can achieve an increased space utility. Further, the spiral extension portion 53 is advantageous to increase the flow distance of a refrigerant in the discharge muffler 39 to the maximum extent.

The diameter of the above described communication path 50 is smaller than the diameter of the conventional communication path. For example, different from the conventional communication path having a diameter of about 6 mm, the diameter of the communication path according to the present invention is below 6 mm. However, it is noted that the communication path 50 preferably has a diameter of 2.5 mm or more since an excessively small diameter may reduce the flow rate of a refrigerant. The inner diameter of the auxiliary communication tube 51 is determined to be equal to the diameter of the communication path 50.

The auxiliary communication tube 51 is connected with the communication path 50. Accordingly, a refrigerant, having passed through the communication path 50, passes through the auxiliary communication tube 51. That is, the refrigerant flow distance, i.e. the second section from the discharge chamber 37 to the discharge muffler 39 increases.

By reducing the diameters of the communication path 50 and the auxiliary communication tube 51 and also, by coupling the auxiliary communication tube 51 with the communication path 50 to increase the flow distance of the refrigerant, the present invention can attenuate a discharge pulsation, and more particularly, can attenuate a vibration and noise of the hermetic compressor via a reduced low-frequency component of the discharge pulsation.

The present invention further employs resonant channels 56 provided at opposite sides of the communication path 50. The resonant channels 56 take the form of a Helmholtz resonator. In this case, the resonant channels 56 have a diameter larger than the diameter of the communication path 50.

The resonant channels 56 are obtained by machining the cylinder block 31 such that one end of each resonant channel 56 communicates with the discharge chamber 37 and the other end of the resonant channel 56 is blocked. That is, the resonant channel 56 is a groove in the cylinder block 31 at a predetermined depth from the discharge chamber 37. Here, by adjusting the depth (i.e. the length) and the diameter of the resonant channel 56, it is possible to attenuate a high-frequency component of the discharge pulsation.

Now, refrigerant compression and discharge operations of the hermetic compressor having the above described configuration will be described. Referring to FIGS. 1 and 2, if the piston 34 moves the lower dead center of the compression chamber 33 by a rotation of the crankshaft 23, a low-temperature/low-pressure refrigerant is introduced from the evaporator (not shown) into the refrigerant suction pipe 41. After sequentially passing through the suction muffler 40 and the suction chamber 36 of the cylinder head 35, the refrigerant is introduced into the compression chamber 33 through the valve assembly 38.

With a further rotation of the crankshaft 23, the piston 34 moves to the upper dead center of the compression chamber 33, thereby changing the low-temperature/low-pressure refrigerant into a high-temperature/high-pressure refrigerant. After staying in the discharge chamber 37 of the cylinder head 35 for a short time, the compressed refrigerant is introduced into the discharge muffler 39 through the communication path 50. Thereafter, the compressed high-temperature/high-pressure refrigerant is discharged into the condenser (not shown) by way of the refrigerant discharge pipe 55. In this case, a refrigerant flow section from the discharge muffler 39 to the outside of the compressor through the refrigerant discharge pipe 55 is referred to as a third section.

In the above described hermetic compressor or reciprocating type compressor, the piston 34 reciprocates by a predetermined period in the compression chamber 33 to suction or discharge the refrigerant. This makes for the refrigerant to be discharged discontinuously, causing a discharge pulsation. The discharge pulsation of the refrigerant results in a vibration and noise of the compressor.

As a solution to attenuate the discharge pulsation, the present invention can increase the length of the communication path 50 or decrease the cross sectional area of the communication path 50. Specifically, to increase the length of the communication path 50, according to the present invention, the auxiliary communication tube 51 is coupled with the communication path 50 and is disposed in the discharge muffler 39. This can solve the problem of the prior art wherein the communication path defined in the cylinder block has a limit to increase a length thereof. Also, by providing the communication path 50 and the auxiliary communication tube 51 with smaller cross sectional areas than those of the prior art, the discharge pulsation can be attenuated with a higher efficiency.

Although the above embodiment describes reducing the diameters of the communication path 50 and the auxiliary communication tube 51 and coupling the auxiliary communication tube 51 with the end of the communication path 50 for the sake of increasing the flow distance of the refrigerant, hereinafter, another embodiment using the communication path 50 having the same diameter as that of the prior art and the auxiliary communication tube 51 having a smaller inner diameter than the diameter of the communication path 50 will be described in detail.

Figure 4:
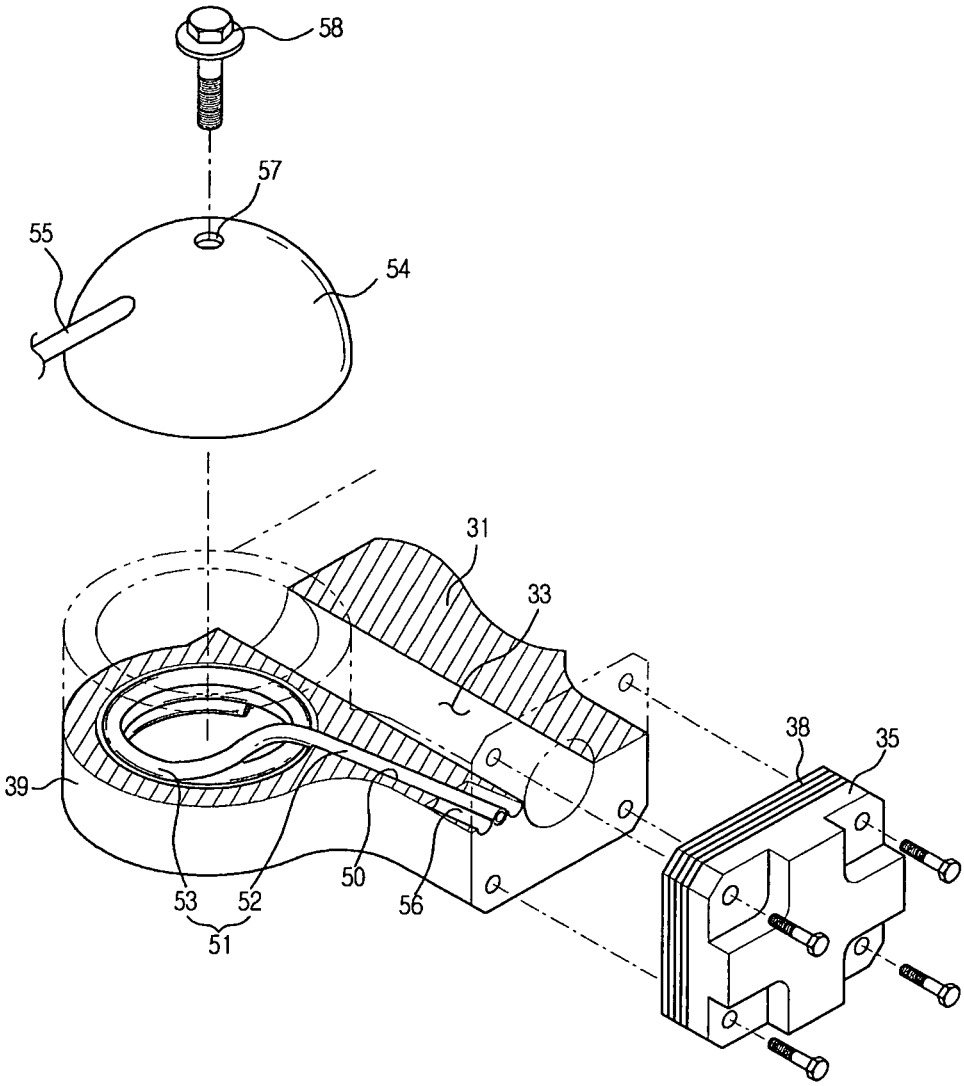
FIG. 4 is an exploded perspective view showing important parts of a compression device according to another embodiment of the present invention.

FIG. 4 is an exploded perspective view illustrating important parts of a compression device according to another embodiment of the present invention.

As shown in FIG. 4, the communication path 50 has a straight tubular shape to communicate the discharge chamber 37 and the discharge muffler 39 with each other. The auxiliary communication tube 51 is inserted into and coupled with the communication path 50.

The auxiliary communication tube 51 includes the coupling portion 52 to be coupled with the communication path 50, and the extension portion 53 extending from the coupling portion 52 to increase the flow distance of the refrigerant. The extension portion 53 has a spiral shape, and is vertically disposed in the discharge muffler 39. Since the coupling portion 52 has a straight shape and the extension portion 53 has a spiral shape, the connecting region of the coupling portion 52 and the extension portion 53 is curved. Preferably, the connecting region of the coupling portion 52 and the extension portion 53 has a gentle curvature to assure smooth flow of the refrigerant.

The auxiliary communication tube 51 has an outer diameter equal to a diameter of the communication path 50 such that the auxiliary communication tube 51 is inserted into the communication path 50. In the present embodiment, a length of the coupling portion 52 is equal to or larger than a length of the communication path 50, and the coupling portion 52 is inserted into and coupled with the communication path 50. This is to reduce a cross sectional area of the communication path through which the refrigerant flows.

By inserting the coupling portion 52 into the communication path 50, the cross sectional area of the communication path 50 is reduced, and the flow distance of the refrigerant is increased by the extension portion 53. As a result, similar to the above description, the discharge pulsation can be attenuated, and more particularly, a low-frequency component of the discharge pulsation can be attenuated.

As described above with relation to FIG. 2, when providing the resonant channels 56 having a predetermined depth in the cylinder block 31 starting from the discharge chamber 37, a high-frequency component of the discharge pulsation can be attenuated. The resonant channels 56 shown in FIG. 4 are identical to those of FIG. 2, and thus, a detailed description thereof is omitted herein.

As apparent from the above description, the present invention provides a hermetic compressor in which an auxiliary communication tube is coupled with a communication path, to reduce a cross sectional area of a refrigerant flow passage while increasing a refrigerant flow distance. The use of the auxiliary communication tube has the effect of attenuating a low-frequency component of a discharge pulsation.

Further, according to the present invention, resonant channels are defined in a cylinder block to communicate at one end thereof with a discharge chamber. This has the effect of attenuating a high-frequency component of the discharge pulsation.

By attenuating the low-frequency and high-frequency components of the discharge pulsation, consequently, a vibration and noise of the hermetic compressor can be attenuated, resulting in an improved satisfaction of consumers.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A hermetic compressor comprising:

a cylinder head including a discharge chamber to discharge a compressed refrigerant;

a discharge muffler to receive the refrigerant discharged from the discharge chamber;

a communication path to communicate the discharge chamber and the discharge muffler with each other, so as to guide the refrigerant from the discharge chamber into the discharge muffler; and an auxiliary communication tube including a coupling portion coupled with the end portion of the communication path located toward the discharge muffler and an extension portion extending from the coupling portion to increase a refrigerant flow distance of a refrigerant, the extension portion having a spiral shape that spirals along an inner circumferential surface of the discharge muffler, the entirety of the extension portion being received in the discharge muffler.

2. The hermetic compressor according to claim 1, wherein the communication path has the same diameter as an inner diameter of the auxiliary communication tube.

3. The hermetic compressor according to claim 2, wherein an end portion of the communication path is stepped to have the same diameter as an outer diameter of the coupling portion, to allow the auxiliary communication tube to be inserted into the communication path.

4. The hermetic compressor according to claim 1, wherein the auxiliary communication tube has a diameter smaller than a diameter of the communication path.

5. The hermetic compressor according to claim 4, wherein the coupling portion is inserted into the communication path to reduce a cross sectional area of the communication path as a refrigerant flow passage.

6. The hermetic compressor according to claim 1, further comprising:

a cylinder block including a compression chamber to discharge the refrigerant into the discharge chamber, wherein the cylinder block comprises a resonant channel having one end to communicate with the discharge chamber and an other end which is blocked.

7. The hermetic compressor according to claim 6, wherein the resonant channel has a diameter larger than a diameter of the communication path.

8. The hermetic compressor according to claim 1, wherein the diameter of the communication path is approximately 2.5 mm.

9. The hermetic compressor according to claim 1, wherein the diameter of the communication path is between 2.5 mm and 6.0 mm.

* * * * *